US005168525A

United States Patent [19]

Müller

[11] Patent Number: 5,168,525

[45] Date of Patent: Dec. 1, 1992

[54] BOUNDARY-LAYER MICROPHONE

[75] Inventor: Bernhard Müller, Berlin, Fed. Rep. of Germany

[73] Assignee: Georg Neumann GmbH, Berlin, Fed. Rep. of Germany

[21] Appl. No.: 567,572

[22] Filed: Aug. 15, 1990

[30] Foreign Application Priority Data

Aug. 16, 1989 [DE] Fed. Rep. of Germany ..... 3926884

[51] Int. Cl.[5] ..... H04R 1/02; H04R 25/00

[52] U.S. Cl. ..... 381/91; 381/87; 381/88; 381/150; 381/168

[58] Field of Search ..... 181/157, 173, 191; 381/150, 160, 168, 169, 191, 192, 202, 203, 205, 92, 155, 91, 87, 88

[56] References Cited

U.S. PATENT DOCUMENTS

| | | | |
|---|---|---|---|
| 4,314,098 | 2/1982 | Maerfeld | 381/160 |
| 4,700,396 | 10/1987 | Bolin | 381/91 |
| 4,742,548 | 5/1988 | Sessler et al. | 381/92 |

FOREIGN PATENT DOCUMENTS

| | | | |
|---|---|---|---|
| 0059697 | 4/1983 | Japan | 381/203 |
| 0244190 | 12/1985 | Japan | 381/203 |
| 0024399 | 2/1986 | Japan | 381/203 |

OTHER PUBLICATIONS

Crown International, Inc., "Pressure Zone Microphone", PZM-20R and PZM Microphones, Jan. 1990.

English translation of "Flach wie eine Flunder," Funkschau, No. 16, 1985, pp. 43 and 45.

"Flach wie eine Flunder," *Funkschau,* No. 16, 1985, pp. 43 and 45.

*Primary Examiner*—James L. Dwyer
*Assistant Examiner*—William Cumming
*Attorney, Agent, or Firm*—Robert J. Koch

[57] ABSTRACT

A boundary-layer microphone may obtain a frequency independent, hemispherical directional characteristic with a high tonal quality. The geometrical configuration of the mounting plate and the installed location of the membrane within the surface of the mounting plate are chosen so that a flat frequency response is obtained at the installed location of the membrane, i.e., the superposition of the incident primary sound field on the secondary sound field created by diffraction will not cause any deviation from a flat frequency response and a smooth, hemispherical polar pattern. The mounting plate may be triangular. The membrane may be installed in the vicinity of the center of gravity of a scalene triangle.

16 Claims, 3 Drawing Sheets

BOUNDARY-LAYER MICROPHONE

BACKGROUND OF THE INVENTION

1. Field of Invention

The invention relates to an electroacoustic transducer and more particularly to a transducer with a membrane mounted flush with the sound reflecting surface (boundary-layer microphone).

2. Description of The Related Technology

The periodical "Funkschau", No. 16, 1985, pages 43 and 45 describes a transducer with a flush mounted membrane. Standing waves are always formed in a room by the superposition of a directly incident sound field on sound waves reflected from walls. This leads to frequency and location dependent acoustic pressure maxima and minima. The sound waves have a pressure maxima directly in front of a sound reflecting surface. The velocity component perpendicular to the surface disappears as the incident and reflected waves are superposed in the same phase. The acoustic pressure in front of the surface is therefore twice a high as in the free sound field. This effect is utilized in boundary-layer microphones (Funkschau, No. 16, 1985, pages 43–45), in which a miniature electric transducer is mounted on a flat, thin sound reflecting mounting plate. Elastic feet may be provided on the bottom side of the mounting plate to immobilize the plate on a floor, wall or other sound reflecting surfaces. The sensitivity of the transducer is raised by 6 dB relative to the free field due to the increase in sound pressure immediately on the surface up to a double value. This doubling of the acoustic pressure occurs for frequencies where the surface is large compared to the length of the sound waves.

Either circular, square or rectangular reverberant plates are used for known boundary-layer microphones. The transducer element is usually centrally mounted. The plate edges are usually chamfered or irregularly rounded.

SUMMARY OF THE INVENTION

The frequency responses of boundary-layer microphones with circular, square or rectangular plates particularly in the case of a perpendicular sound incidence have strong maxima and minima. These microphones show pronounced irregularities in their polar diagram in the frontal half space. As a result strong and direction dependent acoustic discolorations appear. These shortcomings are caused by a secondary sound field produced by the incident plane wave front at a boundary-layer microphone. This secondary sound field is created by acoustic diffraction at the edges of the plate. A so-called "creeping wave" is formed, which extends over the plate from its edge. The phase shift of the creeping wave relative to the incident wave depend on the phase shift at the plate edge. This phase shift differs as a function of the configuration of the edges and the impedance of the surfaces of the microphone body and the boundary. The creeping wave produces a more or less complex interference pattern depending on the geometric form of the microphone body and the mounting plate. The superposition of the incident wave on the creeping wave at the location of the transducer is decisive for the frequency response of an boundary-layer microphone. Negative effects on the frequency response and the directional characteristic can be avoided only if creeping wave is entirely avoided or if its phase shift in summation is independent of frequency and it has a frequency independent level at the location of the transducer. Theoretically, creeping waves can be avoided only if the mounting plate is infinitely thin or infinitely large. A thickness of 1 to 2 mm, which in practice would suffice to avoid creeping waves, is not feasible technically, as no available electrostatic transducer would fit into such a thin mounting plate.

It is an object of the invention to obtain, a frequency independent, hemispherical directional characteristic electrostatic transducer with a high acoustical quality.

According to the invention an electroacoustic transducer may be built with a membrane arranged flush with the surface of a sound reflecting plate. The plate may have a finite area and thickness. The geometric configuration of the plate (P) and membrane (M) are such that an even frequency response is obtained at the membrane upon superposition of the secondary sound field generated by diffraction at the edge of the plate on the incident primary sound field. The path lengths from every edge point of the plate (P) to the center of the membrane may advantageously be distributed uniformly over a length range. The upper limit of the range may be the acoustic wave length of the upper boundary frequency of the electroacoustic transducer (W) and the lower limit may be the half wave length of the transition frequency for creation of a acoustic pressure doubling in front of the plate (P). According to a further refinement the plate (P) may be triangular or more particularly a scalene triangle. The sides (a,b,c) of the triangular plate (P) may include angles ($\alpha$, $\beta$, $\gamma$) of about 75°, about 45° and about 60°. The membrane M may be located in the vicinity of the center of gravity (S) of the triangular plate (P). Furthermore the membrane (M) may be located approximately on the centroidal axis (s1) of the longest leg (a) of the triangular plate (P) between its center of gravity (S) and the foot (F) of said centroidal axis (s1). The electroacoustic transducer may advantageously include an electrostatic transducer. The electroacoustic transducer may be a pressure calibrated transducer.

The geometrical configuration of the electroacoustic transducer mounting plate and its location in the mounting plate are optimized so that creeping waves at the location of the transducer have frequency independent phase shift in summation and a level independent of frequency. The superposition of the incident wave on the secondary sound field created by diffraction of the microphone plate at the location of the transducer assures no linear influence of the frequency response for any angle of incidence. According to a preferred feature the path lengths from any edge point of the plate to the center of the membrane are distributed uniformly over a range of lengths which is limited by the wave length of the upper limit frequency and half the wave length of the frequency at which the pressure begins to build up in front of the microphone surface. In a particularly favorable manner the plate is in the form of a scalene triangle.

The invention will become more apparent from the example described with reference to the drawings.

BRIEF DESCRIPTION OF, THE DRAWINGS

Figure 1:
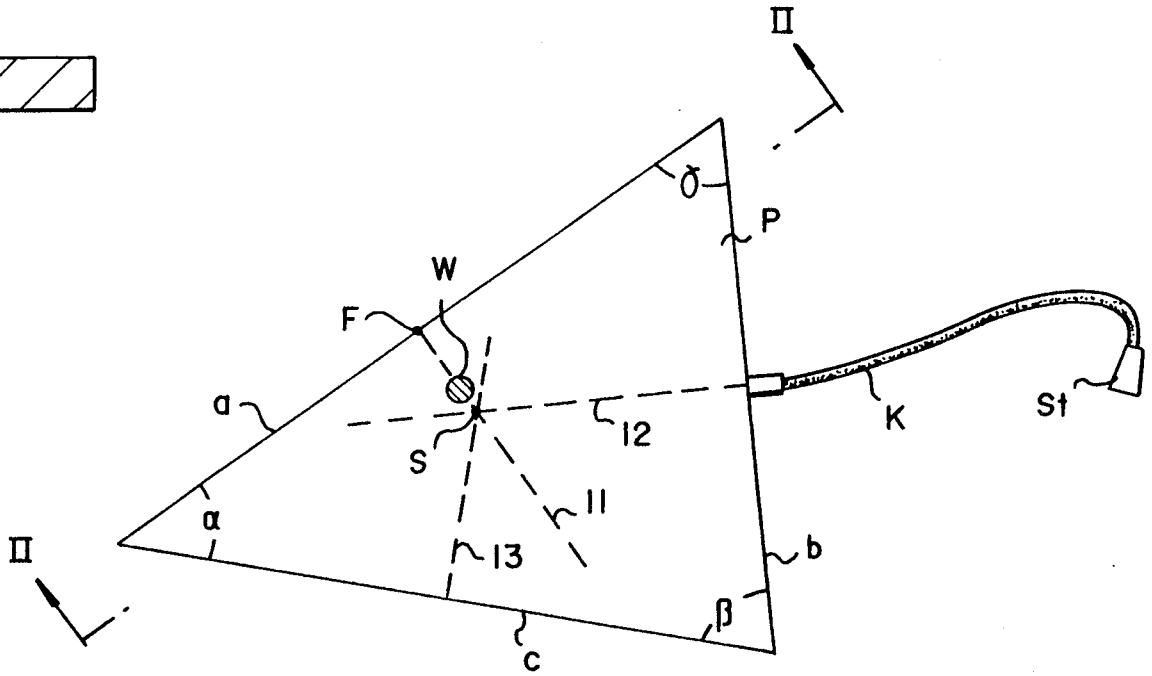
FIG. 1 is a top elevation of an electroacoustic transducer according to the invention.

FIG. 3*a* to 3*d* show frequency responses of the transducer according to FIG. 1 (Curve #1) of an boundary-layer microphone with a rectangular mounting plate (Curve #2) and of an boundary-layerinterface microphone with a circular mounting plate (Curve #3) at different sound incedent angles.

DETAILED DESCRIPTION OF THE PREFERRED EMBODIMENT

Figure 2:
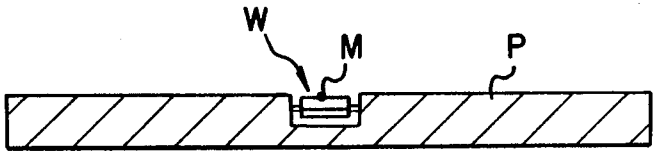
FIG. 2, shows a section through the electroacoustic transducer of FIG. 1 on line II—II.
Figure 3A:
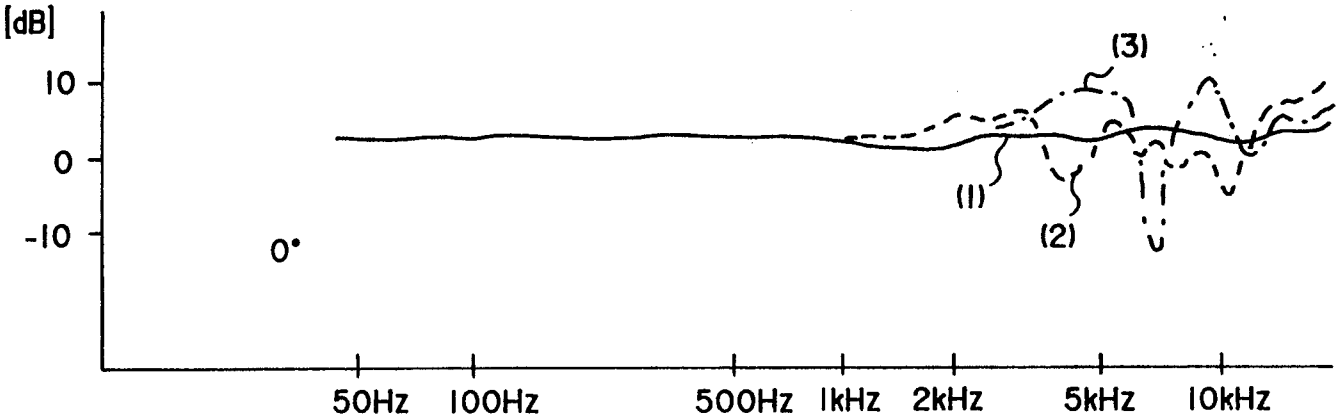
Figure 3B:
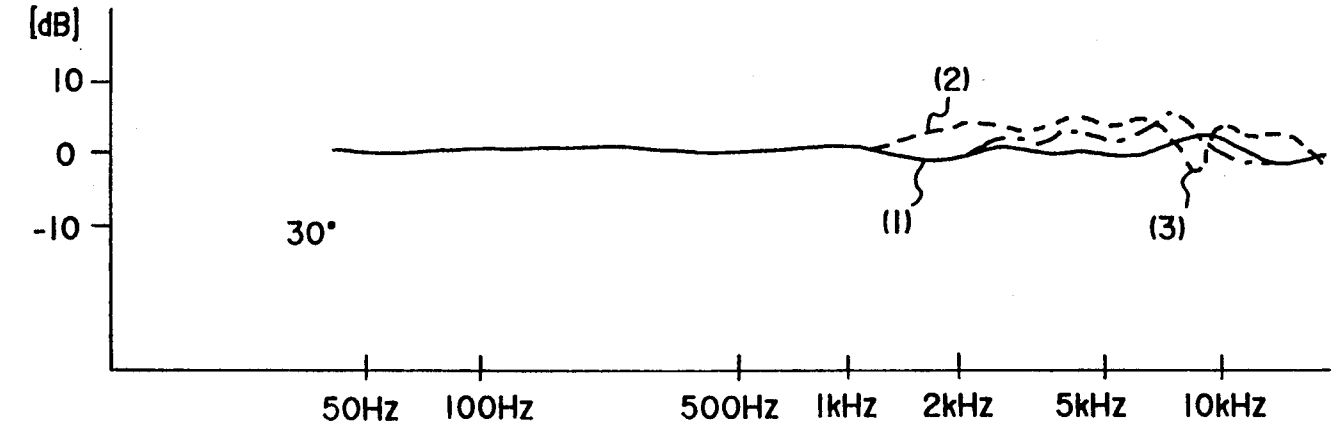
Figure 3C:
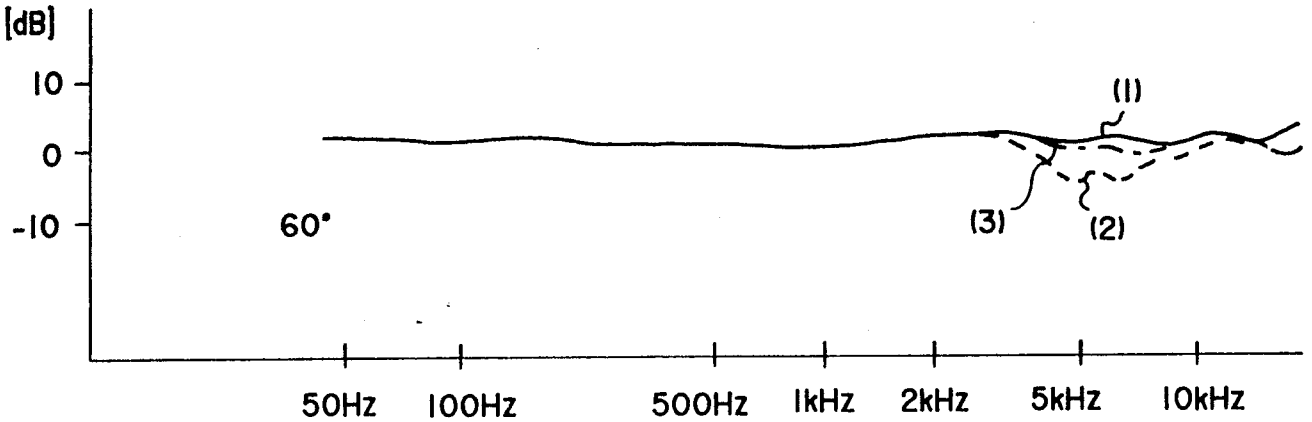
Figure 3D:
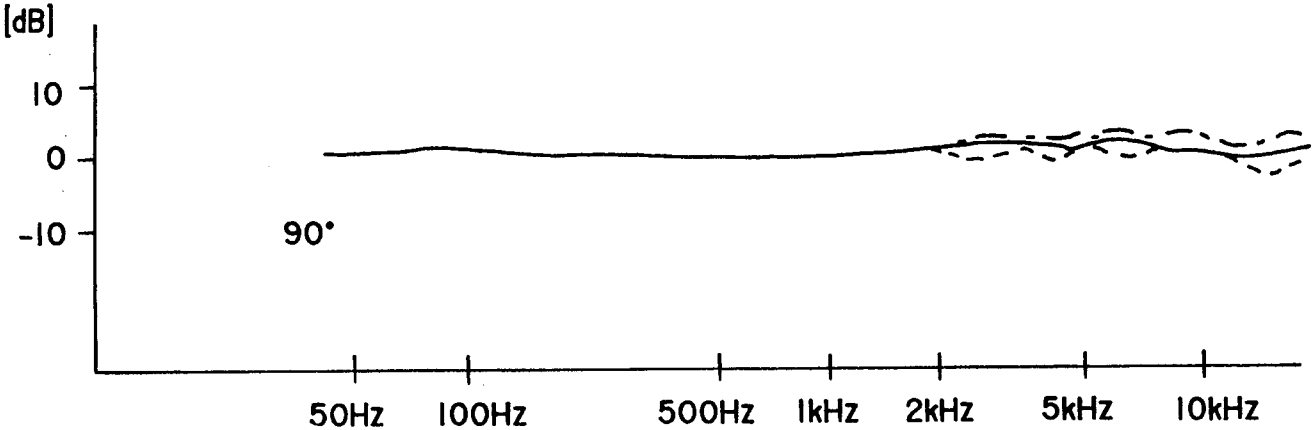

The embodiment shown in a top elevation in FIG. 1 and in FIG. 2 in section of an electroacoustic transducer comprises a triangular support plate P. The lateral edges or legs of the triangle are designated a, b and c. The angles $\alpha$, $\beta$ and $\gamma$ included by the legs a, b and c amount in the example shown approximately to $\alpha=45°$, $\beta=75°$ and $\gamma=60°$. A transducer capsule W is recess mounted on the relatively thin, sound reflecting support plate P in the vicinity of the center of gravity S of the triangle, i.e. of the intersection of the three centroidal lines s1, s2, and s3. Advantageously the membrane M of the transducer capsule is flush with the surface of the plate P facing the incident sound. The exact location of the transducer capsule W in the example shown is located between its foot F and the center of gravity S on the centroidal line. The transducer capsule W is connected through the plate to a microphone cable K installed at the foot of the centroidal line s2 on the shortest leg b. The microphone cable terminates at a cable plug St.

The installation and flush fastening of the transducer capsule W with the surface of the membrane M and in a recess of the mounting plate P are clearly seen in the section of FIG. 2. Preferably the transducer W is an electrostatic transducer or a pressure calibrated transducer, specifically the transducer in case of a constant sound pressure which delivers a constant voltage in the audible range. The frequency response of the electroacoustic transducer W according to FIGS. 1 and 2 was measured under different sound incidence angles of 0°, 30°, 60° and 90° relative to the level surface of the mounting plate P. The results are shown in FIGS. 3*a* to 3*d* by the solid curve #1. As a comparison, the frequency responses of know boundary-layer microphones with a rectangular support plate (broken curve #2) and of a circular support plate (Curve #3) are drawn in FIG. 3*a* to 3*d*.

As seen from a comparison of Curves #1 to #3, the frequency responses under all sound incidence angles are very flat for the electroacoustic transducer of FIG. 1 and 2. There are appreciable deviations from the level at higher frequencies in the case of the boundary layer microphone with the rectangular plate (Curve #2) and the circular plate (Curve #3). This is especially apparent in the 0° frequency responses. The frequency response distortions may be explained by that the creeping waves created by diffraction at the microphone plate have a frequency dependent phase shift and a frequency dependent level at the location of the transducer. According to the invention the geometric configuration of the plate P and the installed location of the membrane M or the capsule W must be chosen so that the superposition of the incident primary sound field with the secondary sound field (creeping field) created by acoustic diffraction at the plate edges yields a flat frequency response at the installed location of the membrane M. This may be obtained in particular if the path lengths from every point on the edge of the plate P to the center of the membrane are distributed uniformly over a certain length range. The upper limit of this length range is determined by the length of the sound wave of the upper boundary frequency of the transducer. The lower limit of the range is determined by one-half of the sound wave length of the frequency (transition frequency) at which the doubling of the acoustic pressure in front of the plate P begins. In other words, the transition frequency is defined as the frequency at which a doubling formation of the acoustic pressure in front of the plate begins.

The flat frequency response obtained at all sound incidence angles with the transducer according to the invention ideally signifies a frequency independent, hemispherical directional characteristic. Direct and diffuse sounds do not result in different tone colorations, such as those appearing for example in a transducer in a free sound field due to the diffraction and shading effect on the microphone body. In addition, the installation of the transducer flush with the surface of the plate prevents the occurrence of sound distortions such as those appearing in conventional microphones as the result of delayed reflections on room boundary surfaces and the associated comb filter effect.

I claim:

1. A microphone comprising:

a finite area and thickness sound reflecting plate;

an electrical transducer element associated with said plate; and a transducer element membrane located on said plate; wherein said plate is triangular and said membrane is located in a manner such that path lengths from every edge point of said triangular plate to a center of said membrane are distributed uniformly over a length range wherein an upper limit of said range corresponds to an acoustic wave length of an upper boundary frequency and a lower limit of said range corresponds to a half wave length of a transition frequency at which a doubling formation of acoustic pressure begins in a region proximal to a wave incident surface of said triangular plate and an even frequency response is obtained at said membrane upon superposition of an incident primary sound field and a secondary sound field generated by diffraction at an edge of said triangular plate.

2. A microphone according to claim 1, wherein said triangular plate is a scalene triangle.

3. A microphone according to claim 2 wherein included angles of said triangle are about 75°, 45° and 60°.

4. A microphone according to claim 1 wherein said membrane location is near a geometric center of gravity of said triangular plate.

5. A microphone according to claim 4 wherein said membrane is located approximately on a centroidal axis of the longest leg of said triangular plate between said geometric center of gravity and a foot of said centroidal axis.

6. A microphone according to claim 1, wherein said electrical transducer element further comprises an electrostatic transducer.

7. A microphone according to claim 1, wherein said electrical transducer element further comprises a pressure calibrated transducer.

8. A microphone according to claim 1, wherein said transducer element membrane is mounted substantially flush with a surface of said plate.

9. A microphone comprising:

a finite area and thickness sound reflecting triangular plate;

an electrical transducer element associated with said triangular plate; and a transducer element membrane located on said triangular plate near a geometric center of gravity of said triangular plate in a manner such that an even frequency response is obtained at said membrane upon superposition of an incident primary sound field and a secondary sound field generated by diffraction at an edge of said triangular plate.

10. A microphone according to claim 9, wherein said triangular plate is configured and said membrane is located in a manner such that path lengths from every edge point of said plate to a center of said membrane are distributed uniformly over a length range wherein an upper limit of said range corresponds to an acoustic wave length of an upper boundary frequency and a lower limit of said range corresponds to a half wave length of a transition frequency for creation of dynamic pressure in a region proximal to a wave incident surface of said plate.

11. A microphone according to claim 9, wherein said triangular plate is a scalene triangle.

12. A microphone transducer according to claim 11, wherein included angles of said triangle are about 75°, 45° and 60°.

13. A microphone according to claim 9, wherein said membrane is located approximately on a centroidal axis of the longest leg of said triangular plate between said geometric center of gravity and a foot of said centroidal axis.

14. A microphone according to claim 9, wherein said transducer element membrane is mounted substantially flush with a surface of said triangular plate.

15. A microphone according to claim 9, wherein said electrical transducer element further comprises an electrostatic transducer.

16. A microphone according to cliam 9, wherein said electrical transducer element further comprises a pressure calibrated transducer.

* * * * *